US006736663B2

(12) United States Patent
Lee et al.

(10) Patent No.: US 6,736,663 B2
(45) Date of Patent: May 18, 2004

(54) ELECTRICAL CONNECTOR HAVING LATCHING MECHANISM

(75) Inventors: Han Ker Lee, Shenzhen (CN); James Tang, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/301,342

(22) Filed: Nov. 20, 2002

(65) Prior Publication Data

US 2004/0043654 A1 Mar. 4, 2004

(30) Foreign Application Priority Data

Sep. 3, 2002 (CN) ..... 02273041 U

(51) Int. Cl.[7] ..... H01R 13/627
(52) U.S. Cl. ..... 439/358; 439/353; 439/355
(58) Field of Search ..... 439/358, 357, 439/353, 355

(56) References Cited

U.S. PATENT DOCUMENTS 4,961,711 A * 10/1990 Fujiura et al. ..... 439/357
5,494,452 A * 2/1996 Matsumoto et al. ..... 439/358
6,149,451 A * 11/2000 Weber ..... 439/358
6,231,392 B1 * 5/2001 van Woensel ..... 439/610
6,371,789 B1 * 4/2002 Sato et al. ..... 439/358
6,585,536 B1 * 7/2003 Wu ..... 439/358

* cited by examiner

*Primary Examiner*—Michael C. Zarroli
(74) *Attorney, Agent, or Firm*—Wei Te Chung

(57) ABSTRACT

An electrical connector (2) of the present invention adapted to engage with a complementary receptacle connector, includes a housing (20) defining a plurality of through holes (24) therein for receiving a plurality of contacts, a cover (30) engaging with the housing and defining a receiving space (34) for receiving a plurality of coaxial cables, and a latching mechanism (40) engaging with the cover. The latching mechanism includes a locking sheet (41) forming a first and second free ends and a base sheet (42) connecting with the locking sheet via a connecting portin (426). A pair of locking tabs (43) project from the second free end for locking the connector to a receptacle connector.

18 Claims, 4 Drawing Sheets

ELECTRICAL CONNECTOR HAVING LATCHING MECHANISM

BACKGROUND OF THE INVENTION

1. Field of the Invention

The present invention relates to electrical connectors, and more particularly to an electrical connector having a latching mechanism for latching the connector to a complementary connector.

2. Prior Art

It is common practice in the electrical connector art to provide on all plastic connectors integral latching arrangements which will allow positive locking together of the mating plug and receptacle connectors thereby assuring that electrical continuity is maintained under varying conditions of vibration and separating forces which would otherwise result in the loss of electrical continuity.

Such a conventional electrical connector is disclosed in U.S. Pat. No. 5,011,425. Referring to FIG. 1, the connector includes a latching lever 10 which has a first and second free ends 13, 14, and a first and second pivot points 11, 12 located between the first and second free ends 13, 14. A pawl 15 projects outwardly from the first free end 13 for locking the connector to an engaging connector. Part 16 of the latching lever 10 is the portion between the pivot points 11, 12 of reduced thickness and is curved inwardly. This prevents part 16 from bending outwardly when the connector is being disconnected. In operation, when disengaging the two mating connectors, the second free end 14 is pressed downwardly, and the part 16 is pivoted about the second pivot point 12. Sequently, the first free end 13 is pivoted about the first pivot point 11 and the pawl 15 moves downwardly together with the first free end 13, whereby the connector escapes from the complementary connector to disconnect the connection.

However, the two pivot points provided make the process of the disconnecting action more complicated, resulting in an increased probability of the latching lever 10 being damaged. Additionally, a force required against the latching lever 10 to disconnect the connectors is relatively large, which makes it difficult for some users to use.

SUMMARY OF THE INVENTION

An object of the present invention is to provide an electrical connector having a latching mechanism which makes disconnection of the connector from a complementary receptacle connector more convenient.

To accomplish the above-mentioned object, an electrical connector of the present invention adapted to engage with a complementary receptacle connector, includes a housing defining a plurality of through holes therein for receiving a plurality of contacts, a cover engaging with the housing and defining a receiving space for receiving a plurality of coaxial cables, and a latching mechanism engaging with the cover. The latching mechanism includes a locking sheet forming a first and second free ends and a base sheet connecting with the locking sheet via a connecting portion. A pair of locking tabs project from the second free end for locking the connector to a receptacle connector.

Further objects and advantages of the present invention will become more apparent from a consideration of the drawings and the following detailed description.

DETAILED DESCRIPTION OF THE PREFERRED EMBODIMENT

Figure 1:
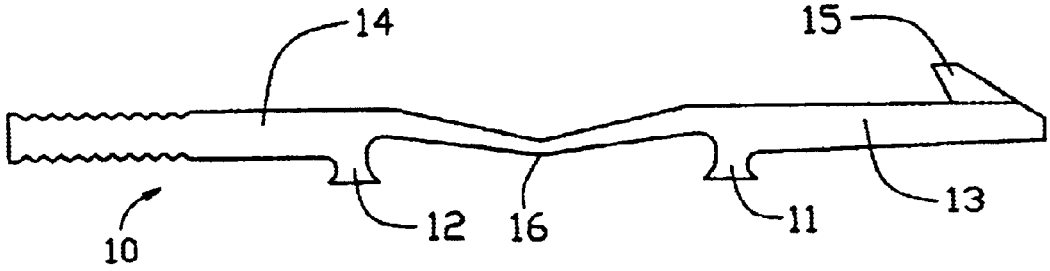
FIG. 1 (PRIOR ART)
FIG. 1 is a side view of a latching lever of an electrical connector of the prior art.
Figure 2:
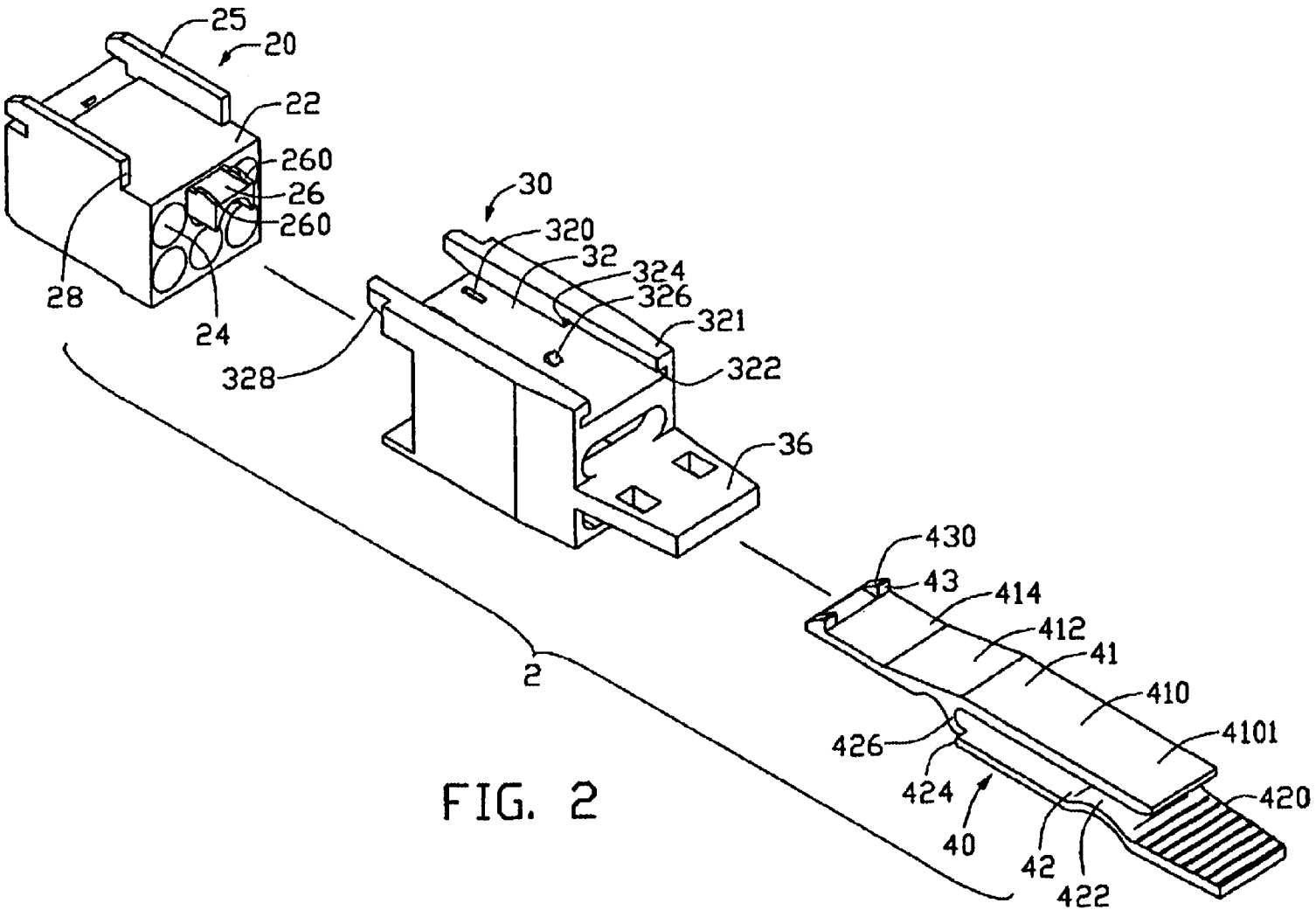
FIG. 2 is an exploded perspective view of an electrical connector in accordance with the present invention.

Referring to FIG. 2, an electrical connector 2 in accordance with the present invention includes an insulative housing 20, a plastic cover 30 and a latching mechanism 40. The housing 20 includes a top face 22 and a plurality of through holes 24 for receiving contacts (not shown). Since a structure of the contacts is well known by those of common skill in the art, a further detailed description of the contacts is omitted herein. A mounting portion 26 extends rearwardly from a rear face (not labeled) of the housing 20. The mounting portion 26 defines a pair of ridges 260. A pair of flanges 25 projects upwardly from the top face 22 along two lateral walls (not labeled) and each flange forms a step 28.

The cover 30 includes a top wall 32 and defines a receiving space 34 (see FIG. 4) for receiving a plurality of coaxial cables (not shown). The coaxial cables electrically connect with the contacts. The top wall 32 defines two grooves 320 for engaging with the ridges 260 of the mounting portion 26 of the housing 20. A pair of locating arms 321 are disposed on the top wall 32. Each arm defines a recess 322 which terminates at a stopper 324. Each arm further forms a cutout 328 at a front end (not labeled) thereof for engaging with the step 28 of the housing 20. The top wall 32 further forms a boss 326. A platform 36 extends rearwardly from a rear wall (not labeled) of the cover 30 for separating said cables, which are inserted into the cover 30 in two groups, through two holes (not labeled), one above and one below the platform 36.

The latching mechanism 40 is integrally molded and includes a locking sheet 41 and a base sheet 42. The locking sheet 41 includes a flat first section 410 having a first free end 4101, a second section 412, which is inclined, and a flat third section 414 having a second free end (not labeled). The second section 412 connects with the first and third sections 410, 414, respectively. A pair of locking tabs 43, each of which has a ramp front face 430, protrudes upwardly at the second free end of the third section 414. The base sheet 42 includes an end portion 420 at a free end thereof and an arcuate portion 422. The base sheet 42 further forms a pair of engaging portions 424 for engaging with the two stoppers 324 of the cover 30. The base sheet 42 connects with the locking sheet 41 through a connecting portion 426 and the connecting portion 426 also serves as a pivot axle. The base sheet 42 further defines a slot 428 (see FIG. 4) for receiving the boss 326 of the cover 30.

Figure 3:
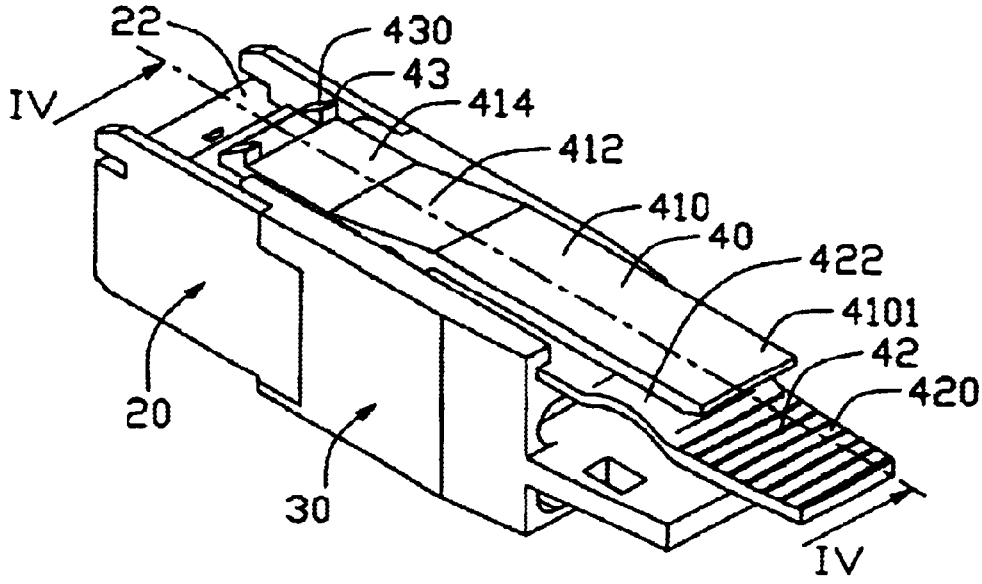
FIG. 3 is an assembled perspective view of the electrical connector of FIG. 2.
Figure 4:
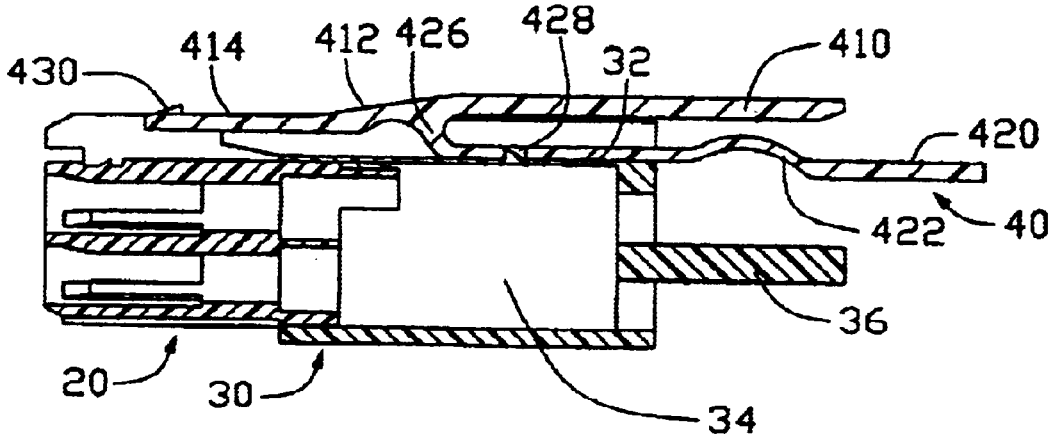
FIG. 4 is a cross-sectional view of the electrical connector of FIG. 3 taken along line IV—IV.

Referring to FIGS. 3–4 together, the connector 2 of the present invention has a symmetrical structure about the plane defined by IV—IV. In assembly, the cover 30 is mounted to the housing 20. The two cutouts 328 of the cover 30 engage with the two steps 28 of the housing 20, respectively. The mounting portion 26 is inserted into the receiving space 34 and the two ridges 260 are locked into the two grooves 320, respectively. Then the latching mechanism 40 is pushed onto the cover 30. Both sides of the base sheet 42 slide into the recesses 322 until the engaging portions 424 are blocked by the stoppers 324. The boss 326 locks into the slot 428 of the base sheet 42, thereby ensuring a stable engagement between the cover 30 and the latching mechanism 40. Since an assembly of the contacts and of the coaxial cables are well known by those skilled in the art, a further description of these is left out here.

Figure 5:
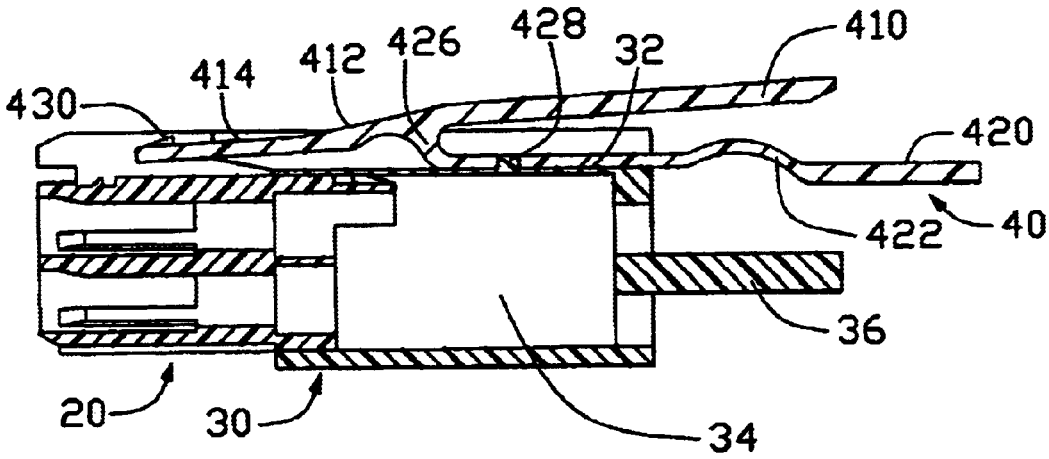
FIG. 5 is a cross-sectional view of the electrical connector during disconnecting the electrical connector from a receptacle connector.

In operation, the connector 2 of the present invention will serve as a plug connector for inserting into a receptacle connector (not shown). The ramp face 430 of the locking tabs 43 of the latching mechanism 40 facilitates the insertion. The connector 2 is locked into the receptacle connector by the locking tabs 43. Referring also to FIG. 5, when disconnecting the connector 2 from the receptacle connector, a user need only use his thumb for example, to finish the action. The base sheet 42 may support the thumb and simultaneously the thumb can press against the first free end 4101 of the locking sheet 41, exerting a force for urging the locking sheet 41 to move upwardly. The third section 414 of the locking sheet 41 pivots about the connecting portion 426 and correspondingly moves downwardly. The locking tabs 43 move together with the third section 414 and escape from the receptacle connector. Thus the connector 2 is disengaged from the receptacle connector.

In the connector 2 according to the present invention, the latching mechanism 40 includes a locking sheet 41 and a base sheet 42 for achieving pivot action together using only one pivot axle. The operating mechanism of the present invention, therefore, is simpler than that of the prior art. Also, disconnecting the connector 2 from the receptacle connector is more convenient and requires a relatively small force.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the housing and the cover can be unitarily made as one piece for simplification.

We claim:

1. An electrical connector adapted to engage with a complementary receptacle connector, comprising:

a housing defining a plurality of through holes therein for receiving a plurality of contacts;

a cover engaging with the housing and defining a receiving space for receiving a plurality of coaxial cables; and a latching mechanism engaging with a top wall of the cover and including:

a locking sheet forming a first and second free ends, a pair of locking tabs projecting from the second free end for locking the connector to the receptacle connector; and a base sheet connecting with the locking sheet via a connecting portion;

wherein, when the connector is to be disconnected, a force directed upwardly is exerted at the first free end of the locking sheet of the latching mechanism, said force causing the first free end to pivot about the connecting portion, so that said first free end moves upwardly and said second free end with the locking tabs correspondingly moves downwardly, whereby the connector is disconnected.

2. The connector as claimed in claim 1, wherein the base sheet of the latching mechanism further forms a third free end.

3. The connector as claimed in claim 1, wherein the base sheet of the latching mechanism further forms a slot.

4. The connector as claimed in claim 1, wherein the base sheet of the latching mechanism further forms an engaging portion for arresting the latching mechanism's forward movement with respect to the housing.

5. The connector as claimed in claim 1, wherein the cover further forms a pair of locating arms on the top wall thereof.

6. The connector as claimed in claim 5, wherein each locating arm defines a recess for receiving the base sheet of the latching mechanism and a stopper for engaging with the engaging portion.

7. The connector as claimed in claim 5, wherein each locating arm defines a cutout on a front thereof.

8. The connector as claimed in claim 3, wherein the cover further includes a boss for engaging with the slot of the base sheet of the latching mechanism.

9. The connector as claimed in claim 1, wherein the cover further defines a pair of grooves.

10. The connector as claimed in claim 7, wherein the housing further forms a pair of flanges and steps at a rear of the flanges, and the steps can engage with the cutouts of the locating arms.

11. The connector as claimed in claim 9, wherein the housing further includes a mounting portion and the mounting potion forms a pair of ridges thereon for engaging with the grooves of the cover.

12. An electrical connector comprising:

an insulative housing with a plurality of contacts therein;

a cover enclosing the housing; and a latching mechanism located on one exterior face of the cover, said latching mechanism including a connection portion functions as a pivot axle, a hook section extending forwardly from the pivot axle with a locking lug at a distal end, an outer deflectable leg extending rearwardly from the connection portion with a pressing region at a distal end thereof, and a base support located behind the connection portion and under the outer deflectable leg; wherein a user is allowed to have a thumb move forwardly along the base support to initially engage the pressing region of the outer deflectable leg and further upwardly deflect the outer deflectable leg about the connection portion to have the hook section inwardly deflected.

13. The connector as claimed in claim 12, wherein the base support is integrally formed with the latching mechanism and rearwardly extends from the connection portion under said outer deflectable leg.

14. The connector as claimed in claim 12, wherein said housing and said cover are two discrete pieces.

15. The connector as claimed in claim 12, wherein said base support further defines a ramp portion to lead upward movement of the thumb of the user.

16. The connector as claimed in claim 12, wherein said latching mechanism and the cover are discrete from each other.

17. A cable end connector comprising:

an insulative housing with a cover enclosing the housing; and a latching mechanism located on one exterior face of the cover, said latching mechanism including a connection portion functions as a pivot axle, a hook section extending forwardly from the pivot axle with a locking lug at a distal end, an outer deflectable leg extending rearwardly from the connection portion with a pressing region at a distal end thereof, and an inner deflectable leg extending rearwardly from the connection portion and under the outer deflectable leg with a support region at a distal end; wherein when operation, the inner deflectable leg and the outer deflectable leg are moved away from each other.

18. A method of releasing a connector from a complementary connector, comprising steps of:

providing a cable connector with an insulative housing with a plurality of contacts therein;

providing a cover enclosing the housing; and providing a latching mechanism located on one exterior face of the cover, said latching mechanism including a connection portion functions as a pivot axle, a hook section extending forwardly from the pivot axle with a locking lug at a distal end, an outer deflectable leg extending rearwardly from the connection portion with a pressing region at a distal end thereof, and a base support located behind the connection portion and under the outer deflectable leg; and forwardly pressing the pressing region along the base support to upwardly deflect the outer deflectable leg, thus resulting in inward deflection of the hook section.

* * * * *